United States Patent [19]

Moller

[11] Patent Number: 4,906,182

[45] Date of Patent: Mar. 6, 1990

[54] GAS COOLING SYSTEM FOR PROCESSING FURNACE

[75] Inventor: Craig A. Moller, Roscoe, Ill.

[73] Assignee: Abar Ipsen Industries, Inc., Feasterville, Pa.

[21] Appl. No.: 236,451

[22] Filed: Aug. 25, 1988

[51] Int. Cl.[4] ..... F27B 3/22

[52] U.S. Cl. ..... 432/77; 432/144; 432/152; 432/199; 432/176

[58] Field of Search ..... 432/199, 144, 152, 77

[56] References Cited

U.S. PATENT DOCUMENTS

| | | | |
|---|---|---|---|
| 4,141,539 | 2/1979 | Bornor . | |
| 4,278,421 | 7/1981 | Limque et al. | 432/199 |
| 4,514,167 | 4/1985 | Royer | 432/152 |
| 4,559,631 | 12/1985 | Moller . | |
| 4,560,348 | 12/1985 | Moller et al. . | |
| 4,612,651 | 9/1986 | Moller et al. . | |
| 4,648,377 | 3/1987 | Van Camp | 432/199 |
| 4,722,683 | 2/1988 | Royer | 432/144 |
| 4,789,333 | 12/1988 | Hemsath | 432/199 |

OTHER PUBLICATIONS

Ipsen Industries Drawing D-159492, Furnace Assy., (2/87).

Ipsen Industries Drawing D-161258, Furnace Assy., (5/87).

*Primary Examiner*—Henry C. Yuen

*Attorney, Agent, or Firm*—Dann, Dorfman, Herrell and Skillman

[57] ABSTRACT

A cooling system for a processing furnace provides improved cooling efficiency in a more compact arrangement than known furnace cooling systems. In the system a blower is situated within the cooling gas plenum but has its intake exterior thereto. The plenum wall and the furnace outer wall define a recirculation channel which is relatively large and free of obstructions. Heat exchanger coils are disposed within the recirculation channel adjacent the blower intake thereby providing a less restricted flow path for the cooling gas.

6 Claims, 4 Drawing Sheets

GAS COOLING SYSTEM FOR PROCESSING FURNACE

The present invention relates to a gas cooling system for a processing furnace. More specifically, the system is a gas cooling system having an internal blower or fan located at one end along the long axis of the furnace in combination with a plenum defining flow paths for directing coolant to orifices or nozzles through the wall of a heat shielded enclosure defining a heat treatment area. The plenum or partition directs the cooling gases under pressure from the blower to the orifice area and into the heat treatment area. A flow channel allows gases to exit from the heat treatment area back along a circulation path defined by the plenum to a heat exchanger and the blower in a novel configuration which provides increased cooling efficiency.

STATE OF THE ART

The need for gas cooling or quenching has increased with the advent of more sophisticated furnaces and the desire for greater capacity and capabilities in processing work. In the prior art a system using inert gases, such as argon or nitrogen, for gas cooling a load of work pieces being heat treated in a furnace had been devised by Craig Moller and Eric H. Wolter, as disclosed in U.S. Pat. No. 4,560,348. Such a system provided a plenum to divide the path of gaseous inflow into the heating chamber from the exhaust path. In this system a heat exchanger coil was provided in the outflow channel between the plenum and the furnace outer wall. Duct work was used to direct flow into and away from a motor driven blower. Such a system, while effective, has not been energy efficient.

THE NATURE OF THE PRESENT INVENTION

The present invention is directed to a heat processing furnace which has the capability of using various inert gases for cooling or quenching which are recirculated through an improved heat exchanger system for cooling. Cooling as in the prior art is accomplished by providing orifices or nozzles through the wall of the heat shielded enclosure within the furnace, arranged and directed so as to provide maximum effectiveness in cooling the pieces being heat treated in the furnace. A plenum is provided from the wall of the heat shielded enclosure enclosing all orifices, back to the fan or blower to divide the confined space between the heat shielded enclosure and outer furnace wall into flow paths from the blower to the orifices and from the enclosure back to the blower. The blower forces the recirculated cooling gas at increased pressure and flow rate into restricted regions bordering the orifices and the orifices are located to provide an effective bathing of the work being processed.

More specifically the present invention relates to a treatment furnace having gas cooling or quenching capability within an outer furnace wall including a door of substantial size with suitable sealing means to retain a gaseous atmosphere. Means for removing gases from within the furnace wall is provided as is means for introducing gases at controlled pressures into the furnace. A heat shielded enclosure defining a heat treatment area is provided within the outer furnace wall and is designed to retain heat within the enclosure and impede its outward flow. The enclosure has a plurality of orifices over a large area and a separate coolant recirculation passage. A plenum surrounds the enclosure in the area perforated by orifices and the recirculation passage along the path. The plenum outer wall divides the space between the furnace wall and the heat shielded enclosure into paths for gas flow in opposite directions on the opposite sides of the plenum wall. The inner path directs the gaseous coolant toward and through the orifices in the heat shielded enclosure and the outer path directs gaseous coolant returning from the enclosure back to a blower. A heat exchanger is located in the return flow path outside of the plenum and adjacent the blower intake side so as to intercept and act upon the gaseous material. Blower means is provided at the end of the plenum remote from the contact of the plenum with the enclosure so that it is between and contacting the gas flow paths defined by the plenum.

DRAWINGS

For a better understanding of the present invention reference is made to the accompanying drawings in which.

DETAILED DESCRIPTION OF THE INVENTION

Figure 1:
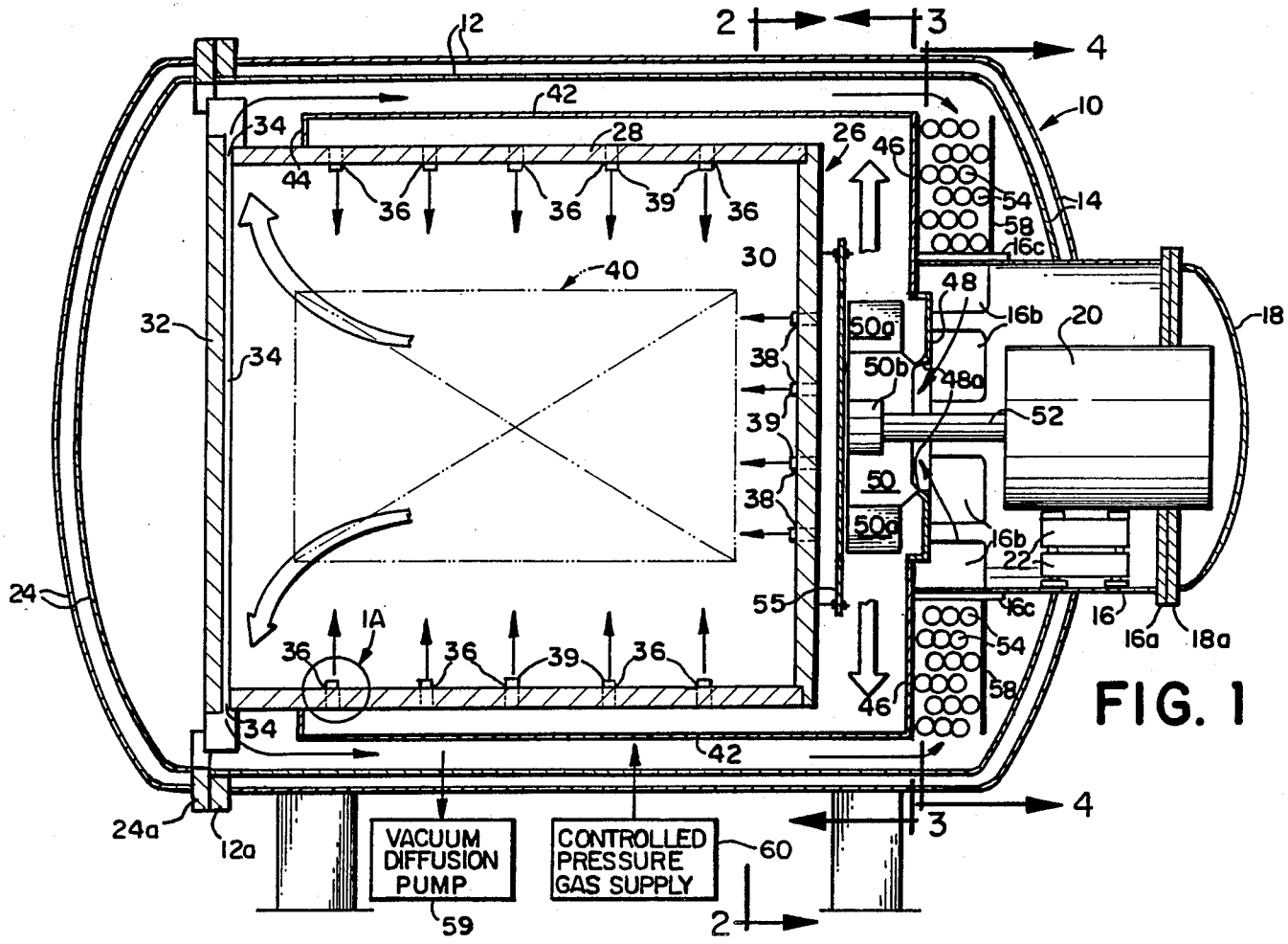
FIG. 1 is a somewhat schematic view partially in section, showing those parts of a furnace to which the present invention applies.
Figure 2:
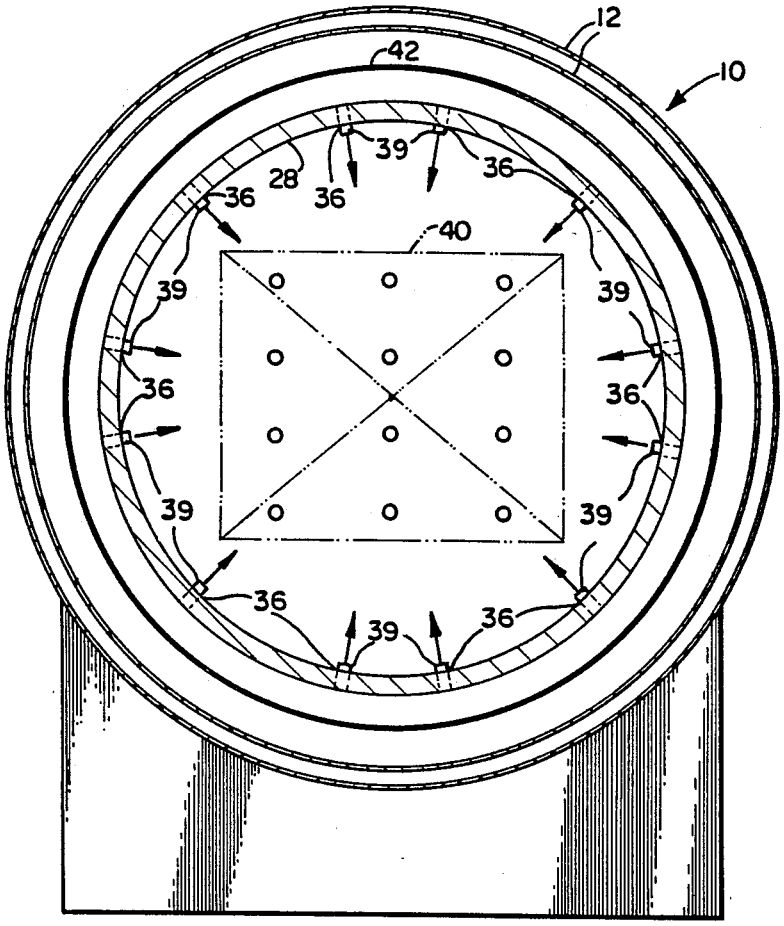
FIG. 2 is a sectional view taken along line 2—2 of FIG. 1 showing the end wall of the heat shielded enclosure.

Referring to FIG. 1 a heat treating furnace generally designated 10 is composed of an enclosure including a double outer wall 12, preferably of generally cylindrical shape, and a domed double end wall 14. The space between the double walls can be insulating space to impede the flow of heat or can be liquid filled and used as a cooling jacket, if desired. End wall 14 is terminated in a cylindrical motor housing and support 16 which has a flanged outer edge **16*a* which mates with a flanged edge 18*a* of a domed end closure 18 for the motor housing. Enclosure 18 is removable for servicing the motor and blower. Although not shown here, the flanges are provided with suitable connection means and sealing means. A motor 20 is supported within the housing on support structure 22. The motor 20 must be provided with electrical connections which pass through and are sealed at motor housing wall 16**.

The opposite end of the furnace is provided with a double wall end closure 24 having a sealing flange **24*a* which cooperates with a sealing flange 12*a* on the cylindrical double wall structure 12. A furnace of the present invention may vary in size but is commonly quite large having a diameter of perhaps six feet or larger. In such large structures the end wall closure 24** is supported in a way not material to the present invention which enables it to be conveniently moved away from the end of the structure to allow the introduction of work pieces to be heat treated, typically supported on refractory pallets for the heat treatment. Although not shown the furnace requires heating elements or other means of heating. One such heating element arrangement is shown in U.S. Pat. No. 4,559,631.

Figure 1A:
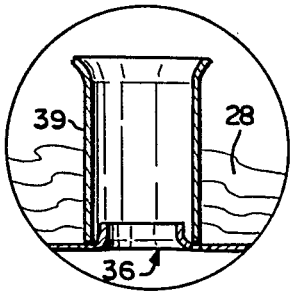
FIG. 1A is a detailed view of an orifice and nozzle according to the present invention.

Within the furnace is a heat shielded enclosure generally designated 26, conforming to the shape of the outer wall and suitably supported by structure not shown but well known in the art. The heat shielded enclosure 26 includes refractory walls made of suitable material to resist intense processing heat. The heat shielded enclosure 26 is designed to retain the heat within the enclosure and impede its flow outwardly. In a cylindrical furnace a cylindrical outer wall 28 is preferably generally coaxially arranged and therefore spaced inwardly somewhat, a uniform spacing distance from the outer furnace walls 12. An end wall 30 of similar construction is attached to the cylindrical sidewalls. A movable end wall 32 at the opposite end of the heat shielded enclosure 26 is of similar construction and a size to generally close the open end of the enclosure 26. The movable wall 32 which completes the heat shielded enclosure 26 is affixed to and moves with the furnace end closure 24. Movable wall 32 is separated from the walls 28 by a passage 34 providing an exit for the cooling gas out of the shielded enclosure 26. The cylindrical outer wall 28 of the heat shielded enclosure is also preferably perforated with a plurality of orifices 36. Similarly a plurality of orifices 38 perforate the end wall 30. The orifices 36 and 38 are so distributed over the wall areas as to provide an inward flow of cooling or heat treating gas in all directions toward the work being treated on pallets or racks arranged in a work area generally designated 40 by the dot and dash lines. In the arrangement shown in the drawings the orifices 36, 38 include nozzles 39 for directing streams of gas into the work area 40. As shown in FIG. 1A the orifices 36, and 38 as well, are flared or rounded into the nozzles 39. Such arrangement advantageously reduces the pressure drop necessary to drive a given volume of coolant through the nozzle, thereby improving the cooling system efficiency.

Figure 3:
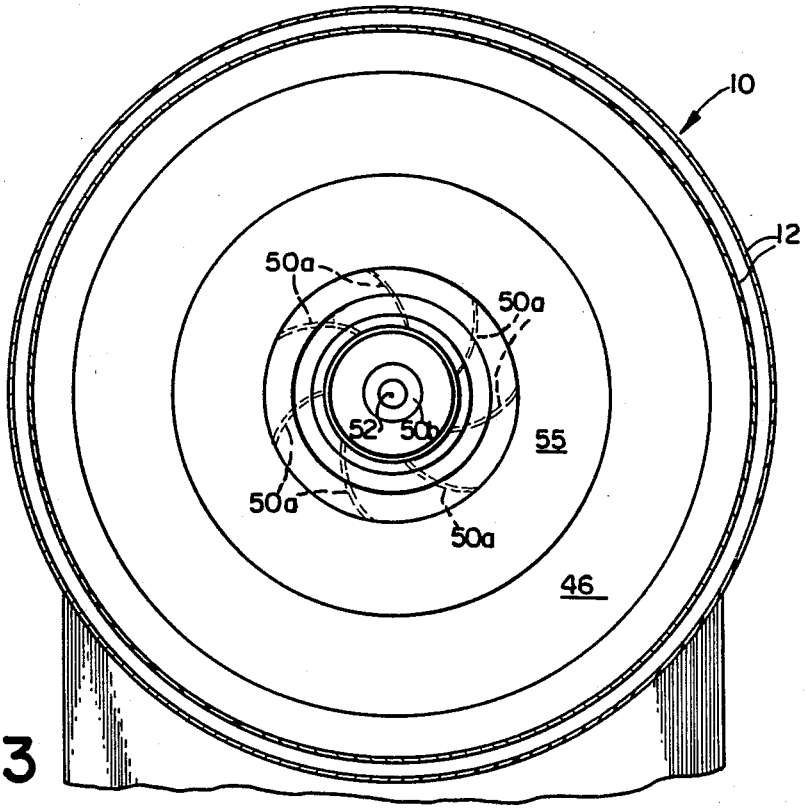
FIG. 3 is a sectional view taken along line 3—3 of FIG. 1 showing the blower and plenum arrangement.

Separating the passage between the furnace wall 12 and the enclosure wall 28 into two parallel flow channels is a plenum having a cylindrical plenum wall 42 connected to the heat shielded enclosure wall 28 by radially inwardly extending plenum end wall 44 located between the orifices 36 and the passage 34. The cylindrical plenum wall 42 extends beyond the end wall 30 of the heat shielded enclosure 26 and the plenum is continued by a planar plenum end wall 46 extending radially inwardly to a cowling 48 partially bordering the intake side of a blower fan 50. Fan 50 is attached at hub **50*b* to shaft 52 of motor 20. In the embodiment shown in FIG. 1 a heat shield 55 is mounted between end wall 30 of enclosure 26 and the fan 50 in order to provide protection from the intense heat generated in the work area 40 during operation of the furnace. The cowling 48 has a curved or flared entry throat 48*a* to minimize turbulence and promote efficient flow into and through the fan 50. The fan in the embodiment shown in FIG. 1 and FIG. 3 has curved blades 50*a* attached to hub 50*b* on shaft 52. The outward flow of air from fan 50 is directed in a generally radial direction throughout 360° in the space defined by the plenum. The plenum itself is adapted to handle the pressure but keep the gaseous atmosphere relatively confined so as to cause relatively even flow through the orifices 36 and 38** onto the workpiece in process.

Figure 3A:
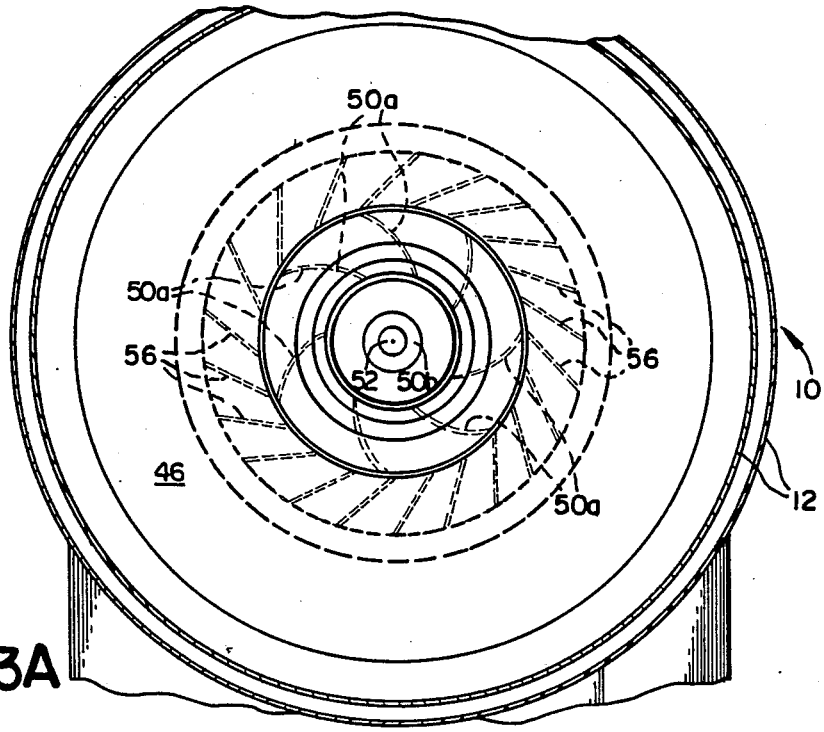
FIG. 3A shows an alternative version of the blower construction that can be used in connection with the present invention.

FIG. 3A shows an alternative blower arrangement comprising a diffuser 53 wherein fixed vanes 56 are generally tangentially directed to impart a spiralling flow to the output of the fan 50.

In either construction, the cooling gas having entered the work area 40 is allowed to flow out through the passage 34 into a coolant recirculation channel. The recirculation channel is defined by the furnace wall 12 and the outer plenum wall 42 and by the walls 46 and 58. Heat exchanger coils 54 are disposed in the recirculation channel between walls 46 and 58.

Figure 4:
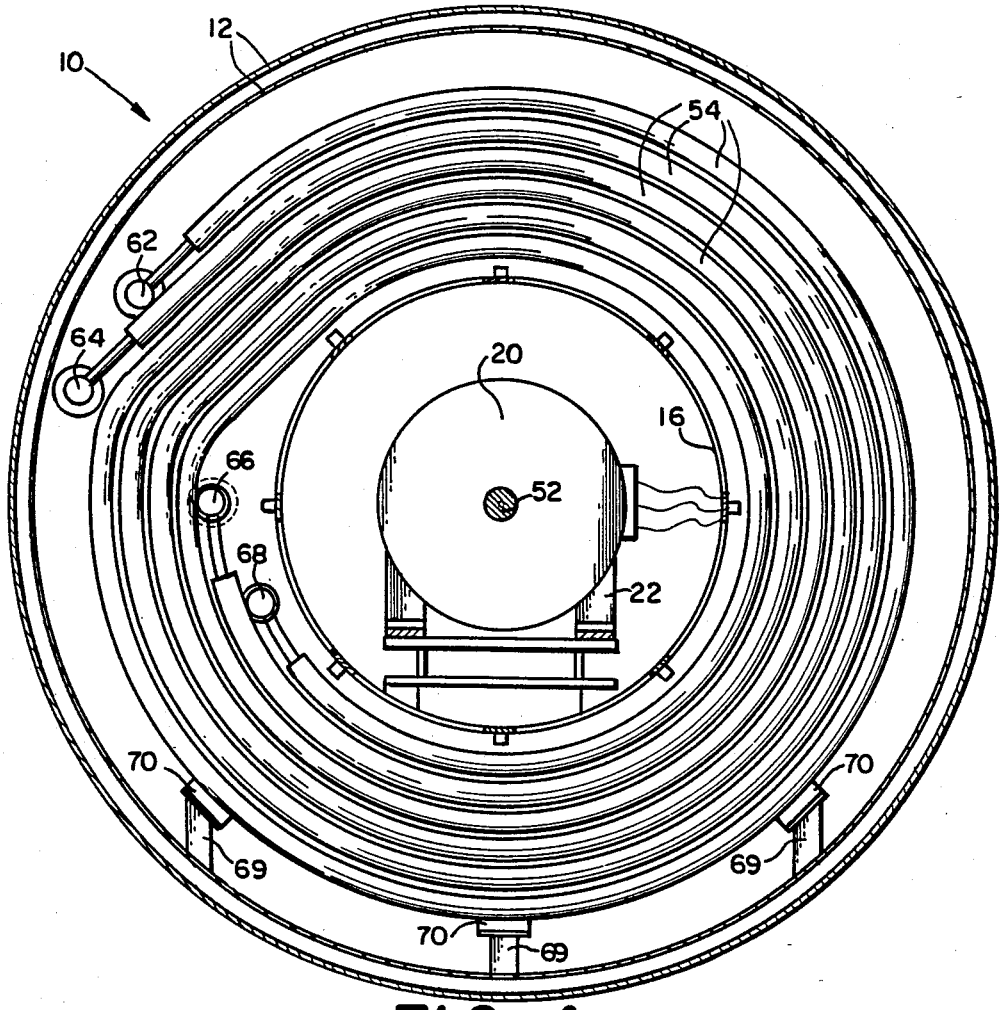
FIG. 4 is a sectional view taken along line 4—4 of FIG. 1 showing a heat exchanger arrangement.

The heat exchanger coils 54 may have a configuration somewhat like that shown in FIG. 4 which shows two separate coils with inputs 62 and 64 and outputs 66 and 68 allowing continuous flow of cooling fluid through a pair of coils. Alternatively, it may use a single coil or multiple coils and the coils may be bifilar or straight through. Whether the coils are wound in helical layers as suggested in FIG. 1 is also a matter of choice. Configuration of the coils, in short, may be varied a great deal.

In order to provide structural support to the plenum wall 46 the motor housing cylinder 16 extends and is joined to that wall. Adjacent wall 46, housing 16 is provided with openings **16*b* spaced around the inboard end of motor housing 16 through which the cooling gas can pass back to the fan 50 through the throat formed by curved throat 48*a* in cowling 48. Reinforcement bars 16*c* add strength and rigidity to the motor housing between the openings 16*b***.

It will be understood by those skilled in the art that in order to provide the desired atmosphere a vacuum diffusion pump, shown schematically as block 59, must be provided to evacuate the chamber. Then a controlled pressure gas supply 60 must be provided to introduce the processing gas which may be introduced at pressures elevated well above atmospheric pressure.

Separate fluid supply and circulating means may be provided to supply coolant fluid to the furnace jacket 12, 14 and the door 24, as desired.

Some of the many advantages and features of the cooling system according to the present invention are now apparent in view of the foregoing description. For example, a novel cooling system for a processing furnace has been described which provides more efficient flow of cooling gases. The improved efficiency of gas flow is realized by greater volume flow at reduced pressure. The arrangement of the fan 50 within the plenum eliminates the need for sharply angled ducts which inhibited flow by their inherent pressure drop zones. Such arrangement also requires less space inside the furnace 10. Thus the length of a furnace which includes the present cooling system can be substantially reduced from prior art furnaces.

The result of the positioning of the heat exchanger coils 54 and the blower fan 50 is that the gas recirculation is advantageously given a large relatively smooth flow path at all points and reaches a maximum constriction at the fan intake throat **48*a***. This is in contrast to the ducts used in the prior art which restricted flow and required greater power to drive the fan due to pressure drops in the sharply angled ducts. The construction of the present invention allows the cooling gas to perform its work and to reach surfaces of the heat exchanger without unduly restricting its flow to narrow confining ducts at any point.

The novel fan and recirculation channel arrangement of the present invention provides a further advantage by permitting circulation of the recirculated gases in and around the motor housing 16 to provide a cooling effect for the fan motor 20. Upon exiting the heat exchanger coils 54, the recirculated gas is cooled sufficiently to absorb heat generated by the fan motor 20. Such arrangement eliminates the need for external or special cooling systems for the fan motor and housing as required in prior art furnaces.

The variations shown are but a few of the many possible arrangements within the scope of the invention. Many other variations will occur to those skilled in the art. All such variations within the scope of the claims are intended to be within the scope and spirit of the present invention.

I claim:

1. A heat treatment furnace having gas cooling or quenching capability comprising an outer furnace wall including a door of substantial size with suitable sealing means to retain a gaseous atmosphere;

means for removing a gas from within the furnace;

means for introducing a gas at controlled pressure into the furnace;

a heat shielded enclosure surrounding a heat treatment zone within the outer furnace wall, said enclosure being designed to retain heat within the zone and impede its outward flow, therefrom said enclosure having a plurality of orifices over a large area and a separate coolant recirculation passage from the enclosure;

a plenum extending from the wall of the enclosure between the area perforated by the orifices and the recirculation passage along a path between the outer furnace wall and the heat shielded enclosure to divide the space between the outer furnace wall and the heat shielded enclosure into gas flow paths having opposite directions on opposite sides of the plenum, said gas flow paths including an inner path within said plenum for directing gaseous coolant flow toward and through the orifices in the heat shielded enclosure and an outer path between said plenum and the outer furnace wall for directing gaseous coolant flow away from the recirculation passage;

a heat exchanger located in the outer flow path within the outer furnace wall and outside and at one end of the heat shielded enclosure so as to intercept the gas flow and act upon the gaseous material;

blower means within and at the end of the plenum remote from the door in the outer furnace wall so that said blower means is between and connecting the outer gas flow path and the plenum for inducing gaseous flow circulation from the heat exchanger, through the blower means to the inside of the plenum and through the orifices into the heat treatment zone, whence it will recirculate to the heat exchanger and the blower means.

2. The heat treatment furnace of claim 1 in which the blower means is provided with an intake opening in a cowling which has a curved surface providing a minimum turbulence intake throat to the blower means.

3. The heat treatment furnace of claim 2 in which the blower means includes a rotating fan member on the shaft of a motor within the furnace wall, the shaft being located on the long axis of the furnace and coaxial with the intake to the blower means.

4. The heat treatment furnace of claim 3 in which the shape of the outer furnace wall is generally cylindrical and the heat shielded enclosure is generally cylindrical and located generally coaxial within the outer furnace wall and the motor shaft is coaxial with both.

5. The heat treatment furnace of claim 4 in which the recirculation passage through the heat shielded enclosure is formed by a gap between an end wall supported on the furnace wall door and the cylindrical wall of the heat shielded enclosure.

6. A heat treatment furnace having gas cooling or quenching capability comprising:

a generally cylindrical outer furnace wall including a door of substantial size with suitable sealing means to retain a gaseous atmosphere;

means for removing gases from within the furnace;

means for introducing gases at controlled pressures into the furnace;

a heat shielded enclosure defining a heat treatment area within the outer furnace wall designed to retain heat within the enclosure and impede its outward flow, said enclosure being generally cylindrical and located generally coaxial with said outer furnace wall, said enclosure having a plurality of orifices over a large area and a separate coolant recirculation passage from the enclosure;

said recirculation passage being formed by a gap between an end wall supported on the furnace wall door and the cylindrical wall of the heat shielded enclosure;

a plenum extending from the wall of the enclosure between the area perforated by the orifices and the recirculation passage along a path between the chamber wall and the heat shielded enclosure to divide the space between the outer furnace wall and the heat shielded enclosure into gas flow paths having opposite directions on opposite sides of the plenum, said gas flow paths having an inner path directing gaseous coolant flow toward and through the orifices in the heat shielded enclosure and an outer path directing gaseous coolant flow away from the recirculation passage;

a heat exchanger located in a flow path within the outer furnace wall and outside and at one end of the heat shielded enclosure so as to intercept the gas flow and act upon the gaseous material; and blower means within and at the end of the plenum remote from contact of the plenum with the enclosure so that it is between and connecting the gas flow path defined by the plenum and inducing gaseous flow circulation from the heat exchanger, through the blower means to the inside of the plenum and through the orifices into the heat shielded enclosure, whence it will recirculate to the heat exchanger and the blower means;

said blower means being provided with an intake opening in a cowling which has a curved surface providing a minimum turbulance intake throat to the blower means;

said blower means including a rotating fan member on the shaft of a motor within the furnace wall, the shaft being located on the long axis of the furnace and coaxial with the intake to the blower means, the outer furnace wall, and the heat shielded enclosure;

said blower means being supported coaxially in a motor housing of generally cylindrical form which extends through the outer furnace wall, said motor housing within the furnace wall extending into a generally planar end wall portion of the plenum and being provided with opening opposite the heat exchanger which is at least one coil of tubing wrapped outside of the motor housing within the furnace wall so that cooling gas passing through the heat exchanger must pass through the opening in the motor housing before entering the curved throat of the cowling to the blower means.

* * * * *